United States Patent [19]

Prsala

[11] Patent Number: 4,735,412

[45] Date of Patent: Apr. 5, 1988

[54] PORTABLE POSTURE CORRECTING APPARATUS

[76] Inventor: Jan Prsala, 47 Hartlen Avenue, Halifax, Nova Scotia, Canada, B3R 1R5

[21] Appl. No.: 612,662

[22] Filed: May 21, 1984

[51] Int. Cl.[4] ..... A63B 21/02

[52] U.S. Cl. ..... 272/138; 272/137; 272/139

[58] Field of Search ..... 272/137, 138, 139; 128/133, 134, 78

[56] References Cited

U.S. PATENT DOCUMENTS 1,734,238 11/1929 Sweeney ..... 272/138

*Primary Examiner*—Richard J. Apley
*Assistant Examiner*—Alan W. Cannon

[57] ABSTRACT

The invention relates to a portable exercise device designed for use by a person in the supine position. The invention consists of three main component parts being, a sturdy rectangular base, resilient means and three straps. The base is placed on the bottom of the user's feet and when the legs are extended the force is transmitted through the resilient means to the straps and then to the muscles of the user's back. While the material used in constructing the invention may vary the basic design must remain unchanged if the invention is to be used effectively in conjunction with the therapeutic exercise program. Of particular importance in this regard are those features of the invention which encourage isotonic contractions of the muscles and the arrangement of the three straps on the user's back which permits interdependent movement of at least two but preferably three of the loops.

6 Claims, 3 Drawing Sheets

PORTABLE POSTURE CORRECTING APPARATUS

BACKGROUND OF THE INVENTION

1. Field of the Invention

The invention relates to an exercise device, in particular to a portable exercise device suitable for people suffering from lower back pain and similar problems.

2. Description of the Prior Art

Various exercise devices have been proposed, often, however, these devices are not suitable for persons with lower back pain, since the very position in which the exercise is performed, such as sitting may well aggravate the condition. In addition many of the devices lack the portability which is necessary in order to allow persons to use the devices when and where time and other circumstances permit. Accordingly it is an object of the instant invention to overcome these deficiencies in previous devices by providing a device that is designed to be used in a supine position which will not further aggravate the lower back problems and which is highly portable. In recent years, more attention has been paid to the problem of lower back pain and the instant invention seeks to provide a portable exercise device suitable for a person with lower back pain or other such condition.

SUMMARY OF THE INVENTION

The instant invention offers a substantial improvement over the prior art as more fully described hereinafter.

There is provided a portable exercise device designed to be used by a person in the supine position and consisting of a sturdy rectangular base, nylon straps, and a resilient material to urge the nylon straps and the sturdy rectangular base together when it is stretched. When the feet are placed on the sturdy rectangular base and the nylon straps are looped around the persons back, beneficial exercise may be achieved when the legs are straightened against the resistance of the resilient material.

The instant invention allows a method of exercising wherein a person assumes a supine position any by the positioning of the person's feet in contact with the sturdy rectangular base and the looping of the three nylon straps around the person's back the forces exerted by straightening the legs are countered by the contractions of the postural muscles of the back. None of the prior art allows the body to be exercised in this position.

The sturdy rectangular base may be composed of hardwood or other material of comparable strength. The resilient material may consist of rubber bands, rubber cords or tension springs. The nylon straps should be fashioned from nylon webbing, but may be made of some other non-expandable material which results in little friction when rubbed against itself.

DESCRIPTION OF PREFERRED EMBODIMENTS

Figure 1:
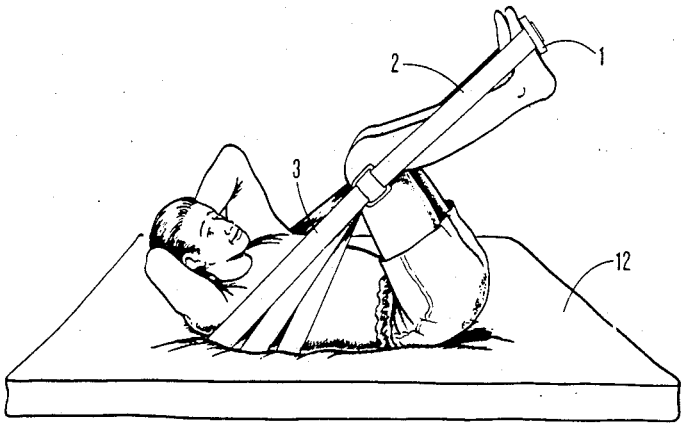
FIG. 1 is a side view of the assembled apparatus indicating its prescribed method of use.

As shown in the drawings, the apparatus consists of three main component parts being a sturdy rectangular base 1, a tension inducing material 2, and nylon straps 3.

The sturdy rectangular base 1 may be composed of hardwood or other material of comparable strength. The tension inducing material 2 may consist of rubber bands, rubber cords, or tension springs. The nylon straps 3 should be fashioned from nylon webbing, but may be made of some other non-expandable material which results in little friction when rubbed against itself.

Six modifications of the apparatus are presented in the drawings. Four of these modifications are a result of changes in design to better accommodate the tension inducing material utilized. One modification results from a different arrangement of the nylon straps. The final modification results from an alteration in the means of connecting the tension members to the nylon straps. The latter two modifications can be used in connection with any of the four basic modifications.

Figure 2:
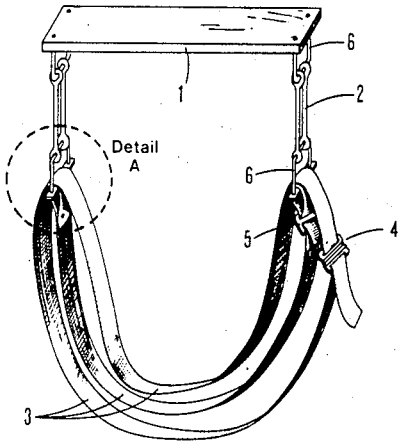
FIG. 2 is a perspective view of the assembled apparatus.
Figure 3:
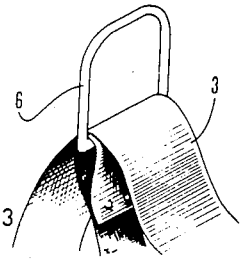
FIG. 3 is an enlarged perspective view of that portion of FIG. 2 marked Detail A showing the arrangement of the nylon straps of the apparatus and the connecting device employed to connect the nylon straps to the tension members.

The basic apparatus is shown in FIG. 2 and utilizes rubber straps 2 as the tension inducing material. Both ends of these rubber straps 2 are attached to U-shaped metal pieces 6. One end of each rubber strap 2 is then connected to the rectangular base 1 by attaching the U-shaped metal piece 6 to the rectangular base 1. The other end of each rubber strap 2 is connected to the nylon straps 3 by attaching the U-shaped metal piece 6 to the nylon straps 3 as shown in FIG. 3.

The nylon straps 3 consist of two separate straps. One of these straps 3 is permanently affixed at one end to one of the U-shaped metal pieces 6 as is shown in FIG. 3. The other end of this strap 3 passes through a sliding buckle 5 then through the U-shaped metal piece and then back through the sliding buckle 5. The sliding buckle 5 allows for adjustments in the length of the strap 3. The other nylon strap 3 is considerably longer and has a fixed buckle 4 on one end. The other end of this strap 3 then passes through both U-shaped metal pieces 6 and through the buckle 4. This buckle 4 again allows for adjustments in the length of the strap 3. The result of this arrangement of nylon straps 3 is that when the apparatus is utilized as indicated in FIG. 1 three straps will cross the user's back. Two of these straps (the upper and lower ones on the back) will move in unison to evenly distribute the forces over the user's back. This united movement and disbursement of forces is necessary for the exercise program to be most effective.

Figure 4:
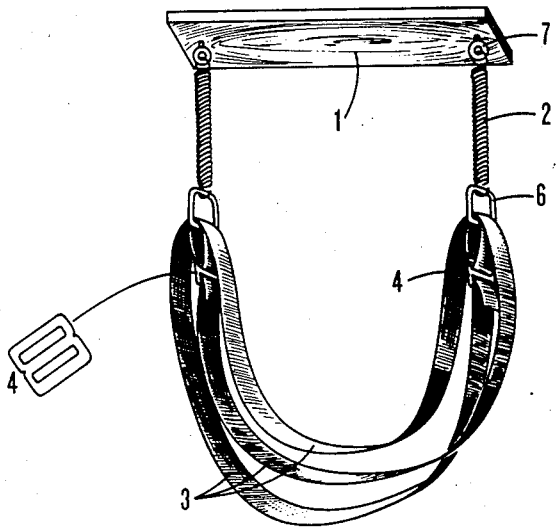
FIG. 4 is a perspective view of a slight modification of the apparatus shown in FIGS. 1–3 utilizing tension springs as the tension members and employing a single nylon strap.

FIG. 4 shows two modifications of the basic apparatus. First the tension inducing material 2 consists of two tension springs 2 connected to the rectangular base 1 by eye bolts 7 and to the nylon straps by D rings 6 instead of U-shaped metal pieces. The change from U-shaped metal pieces to D rings 6 is necessitated by the use of the tension springs. Second, the two nylon straps 3 have been replaced by a single nylon strap 3. One end of this nylon strap 3 is affixed to one of the D rings 6 by folding the end over the D ring 6 and securing it by a sliding buckle 4. The other end is then passed through the second D ring, then through the first D ring and then back to the second D ring where it is attached by a sliding buckle 4 in the manner aforesaid. The sliding buckles 4 allow for adjustments in the length of the straps. This configuration allows for an arrangement of the straps so that three loops pass behind the user's back and move in unison to evenly disburse the forces resulting from the use of the apparatus regardless c,f the position of the legs (i.e. higher or lower). This arrangement of nylon straps 3 can be utilized in any of the modifications of the basic apparatus.

Figure 5:
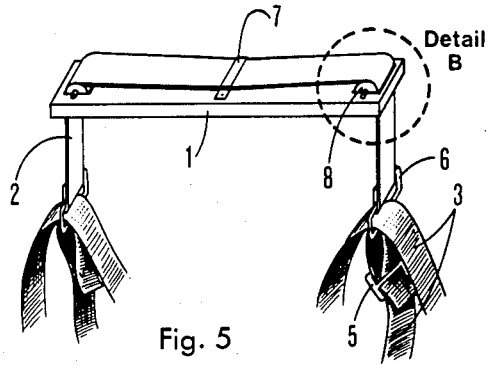
FIG. 5 is a perspective view of a further modification of the apparatus shown in FIGS. 1–3.
Figure 6:
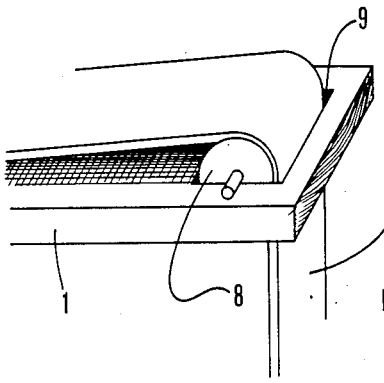
FIG. 6 is an enlarged perspective view of that portion of FIG. 5 marked Detail B.

A further modification of the apparatus is shown at FIG. 5 in which the tension inducing material 2 consists of a single rubber band or cord 2 which passes around pullies 8 placed in slots 9 cut at each end of the rectangular base 1 as shown in FIG. 6. The rubber band or cord 2 moves freely around the pullies 8 and along the back of the rectangular base 1 and is held in place by a clamp 7. The rubber band or cord 2 is connected at each end to a rectangular metal ring 6 through which the nylon straps 3 pass as described above.

Figure 7:
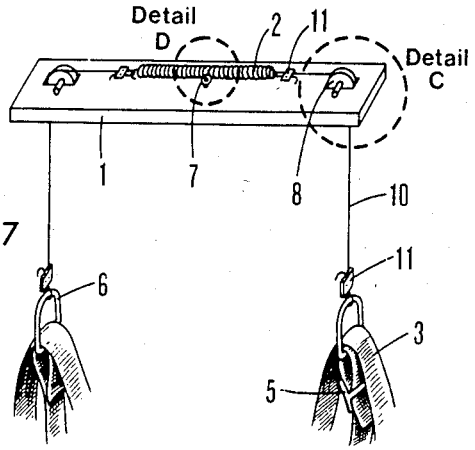
FIG. 7 is a perspective view of a further modification of the apparatus shown in FIGS. 1–3.
Figure 8:
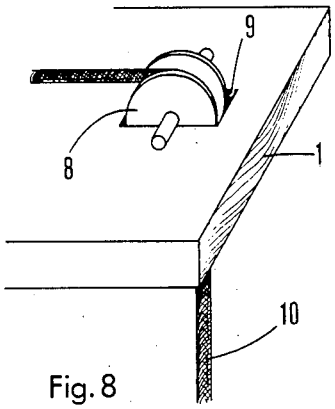
FIG. 8 is an enlarged perspective view of that portion of FIG. 9 marked Detail C.
Figure 9:
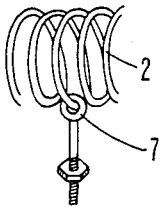
FIG. 9 is an enlarged perspective view of that portion of FIG. 7 marked Detail D.

A further modification of the apparatus is shown in FIG. 7 in which the tension inducing material 2 consists of a single tension spring 2. This tension spring 2 is attached to the back of the rectangular base 1 by an eye bolt 7 placed at the centre of the base 1 as shown in FIGS. 7 and 9. Both ends of the tension spring 2 are attached to metal cables 10 by use of metal clips 11. The cables 10 pass around the pullies 8 placed in the slots 9 cut at each end of the base 1 as shown in FIG. 8 and attach to D rings 6 by means of metal clips 11. The nylon straps 3 pass through the D rings as described above. This modification limits the amount of expansion of the tension spring 2 due to contact between the metal clips 11 and the pullies 8.

Figure 10:
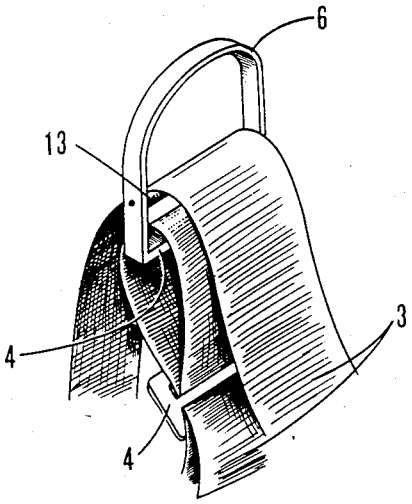
FIG. 10 is a perspective view of the apparatus showing a slight modification of the means of connecting the tension members to the nylon straps.

A modification of the means of connecting the tension members to the nylon straps is shown in FIG. 10. This connecting device can be adapted to replace the U-shaped metal pieces, D rings or rectangular metal rings described above. It consists of the addition of a metal roller 13 to the connecting means. This roller operates as a pulley and permits freer movement of the nylon straps 3. It can be utilized with either arrangement of the nylon straps 3. The nylon straps should be attached as described above to the lower portion 14 of the connecting means. The remaining loops of the nylon straps 3 should pass around the roller to allow ease of movement.

In using the apparatus, the user should assume a supine position on a soft mat or firm bed as shown in FIG. 1. The hips and knees should be bent and the rectangular base 1 placed on the bottoms of the feet. The nylon straps 3 are placed on the various areas of the upper back. The length of the straps 3 can be adjusted so as to allow for the proper amount of tension when the hip and knee joints are extended to the proper angles. In this position a combination of isotonic and isometric exercises may be executed by partially extending the hips and knees and holding the desired position for short periods of time. The final modification presented above is especially effective in obtaining the desired isometric exercise due to the limited expansion of the tension spring. Proper use of the apparatus has been effective in a clinical setting in strengthening and stretching certain muscles of the back responsible for maintaining correct body posture.

Having regard to the foregoing disclosure the following is claimed as the inventive and partentable embodiments thereof:

1. An exercising device comprising:
(a) a rectangular base to be placed on the bottom of the user's feet,
(b) several resilient means operatively attached at one end to the ends of the rectangular base and at the opposite ends connected to two nylon straps,
(c) two nylon straps of adjustable length so arranged to provide three straps to pass around the user's back.

2. The device of claim 1 wherein the two nylon straps are replaced with a single nylon strap of adjustable length so arranged to provide three straps to pass around the user's back and move in unison to evenly disburse force between the three straps.

3. In an exercising device of the character described comprising a rectangular base to be placed on the bottom of the user's feet, resilient means attached at one end to the ends of the rectangular base, means of connecting the resilient means to nylon straps of adjustable length so arranged to provide three straps to pass around the user's back.

4. The device of claim 3 wherein the rectangular base is connected at each end by eye bolts to two tension springs the opposite ends of which are attached to nylon straps of adjustable length so arranged to provide three straps to pass around the user's back.

5. The device of claim 3 wherein the rectangular base has two slots cut in each end in which pullies have been positioned to allow free movement of a single rubber band or cord through the slots and along the back of the base and means to hold the single rubber band or cord in place as its moves along the back of the base with each end of the rubber band or cord connected to nylon straps of adjustable length so arranged to provide three straps to pass around the user's back.

6. The device of claim 3 wherein:
(a) the rectangular base has slots cut in each end in which pullies have been positioned to allow free movement of two metal cables through the slots and along the back of the base;
(b) a single tension spring is attached at the centre of the back of the base by an eye bolt and connected to the metal cables by metal clips;
(c) means of limiting the expansion of the tension spring by contact between the metal clips and the pullies are attached; and the opposite end of the metal cables are attached to nylon straps of adjustable length so arranged to provide three straps to pass around the user's back.

* * * * *